United States Patent [19]

Dixon

[11] Patent Number: 4,747,433

[45] Date of Patent: May 31, 1988

[54] CLAMP TIGHTENING TOOL

[75] Inventor: Paul H. Dixon, Belvidere, Ill.

[73] Assignee: Ingemar Svenningson, Mouscron, Belgium

[21] Appl. No.: 15,794

[22] Filed: Feb. 17, 1987

[51] Int. Cl.[4] ..... B21F 9/00

[52] U.S. Cl. ..... 140/150; 140/123.5

[58] Field of Search ..... 140/93.2, 123.5, 123.6, 140/150

[56] References Cited

U.S. PATENT DOCUMENTS

| | | | |
|---|---|---|---|
| 3,173,456 | 3/1965 | Bailey | 140/123.6 |
| 3,254,680 | 6/1966 | Caveney et al. | 140/93.2 |
| 4,081,002 | 3/1978 | Violi | 140/93.2 |
| 4,181,046 | 1/1980 | Lamb | 140/123.5 |
| 4,399,593 | 8/1983 | DeBradandere et al. | 24/25 |

*Primary Examiner*—Lowell A. Larson

*Attorney, Agent, or Firm*—Leydig, Voit & Mayer, Ltd.

[57] ABSTRACT

A tool for tightening an annular clamping band around a hose includes a substantially V-shaped forming punch adapted to be pivoted to an active position by a reciprocating pneumatic actuator. As the punch pivots to its active position, it rams part of the free end portion of the band into a substantially V-shaped throat formed in an anvil. The actuator then shifts the punch and the anvil in a direction applying tension to the band as the band is drawn between and is reshaped by the punch and anvil.

14 Claims, 4 Drawing Sheets

CLAMP TIGHTENING TOOL

BACKGROUND OF THE INVENTION

This invention relates to a tool for tightening a clamp such as a hose clamp having a flexible annular band and having locking means for holding the band in a tightened condition. More particularly, the invention relates to a tool for tightening a clamp of the nonreusable type. In such a clamp, teeth on the locking means engage teeth on the free end portion of the band as the band is tightened and thereafter the teeth permanently lock the band in its finally tightened condition.

A clamp of this general type and a tool for tightening the clamp are disclosed in Bradandere et al U.S. Pat. No. 4,399,593. With that tool, it is necessary that the free end portion of the clamping band be specially formed in order to enable the tool to engage and tighten the band. Moreover, the manner in which the tool engages and tightens the band can result in substantial variances in the tension which is applied to successive bands of a like type.

SUMMARY OF THE INVENTION

The general aim of the present invention is to provide a new and improved clamp tightening tool which is capable of applying substantially uniform tension to the clamping bands and which avoids the need for a special configuration at the free end portion of the band.

A more detailed object of the invention is to achieve the foregoing by providing a tool in which a forming punch and an anvil uniquely coact to reshape the free end portion of the clamping band just prior to tensioning the band and then tension the band by pulling on the band and causing the latter to tend to return to its original shape.

Still another object is to construct the forming punch and anvil such that the two automatically release the band after a predetermined degree of tension has been placed in the band.

Another object of the invention is to utilize a single and relatively simple actuator for causing the forming punch to first reshape the band and then to apply tension to the band.

The invention also resides in the unique construction of the punch and the anvil enabling the band to be tensioned without locking up between the punch and the anvil.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
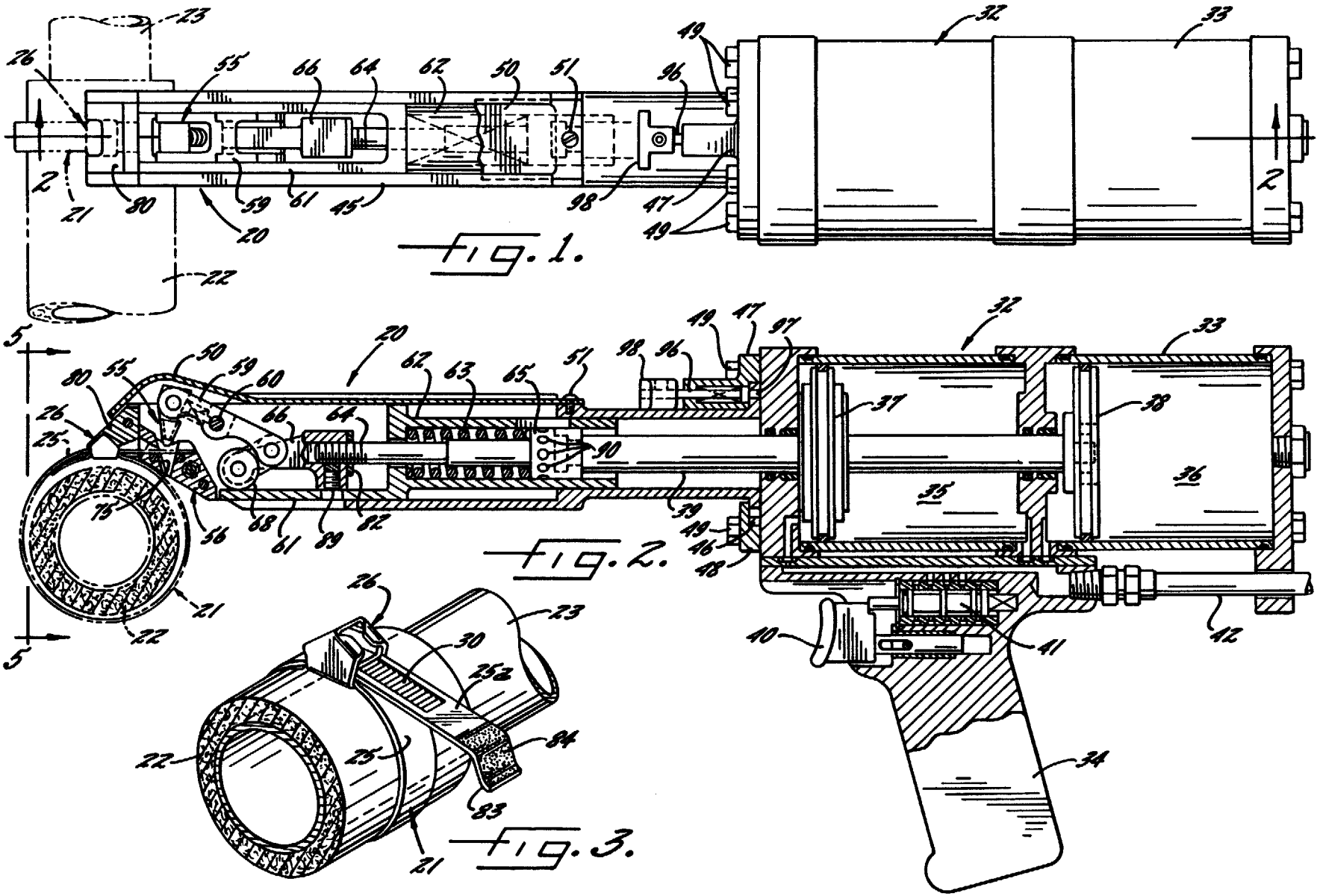
FIG. 1 is a top plan view of a new and improved clamp tightening tool incorporating the unique features of the present invention, certain portions of the tool being broken away for purposes of clarity.
FIG. 2 is a cross-section taken substantially along the 2—2 of FIG. 1.
FIG. 3 is a perspective view showing a typical clamp acting to clamp a hose around a pipe.

For purposes of illustration, the present invention is embodied in a tool 20 for tightening a clamp 21 around a member such as a hose 22 in order to secure the hose to another member such as a pipe 23. The hose and the pipe may, for example, be part of an automotive cooling system and may be clamped to one another at an appropriate point along an automotive assembly line.

The clamp 21 which has been illustrated is of the same general type as disclosed in the aforementioned Bradandere et al patent to which reference is made for a detailed disclosure of the clamp. Briefly, the clamp includes a flexible metallic band 25 formed into a circle and having end portions 25*a* and 25*b* (FIG. 9) which are held in overlapping relation by a locking clip 26. The clip straddles the end portions 25*a* and 25*b* of the band 25 and includes an inside web 27 (FIG. 9) which is secured rigidly to the inside surface of the inside end portion 25*b*. The outside end portion 25*a* of the band is threaded between the inside end portion and a wedging member 28 located within the clip 26. Formed on the wedging member 28 and the outside of the outside end portion 25*a* of the band 25 are teeth 29 and 30, respectively, which are shaped so as to slip past one another when the band is tightened by a pulling force applied to the free end portion of the band. Once the pulling force has been removed from the band, the wedging member 28 locks within the clip 26 and the teeth 29 interlock with certain ones of the teeth 30 so as to hold the band under tension and in a tightened condition.

The present invention contemplates the provision of a relatively compact and lightweight power-operated tool 20 for applying a predetermined degree of tension to the clamping band 25 in order to cinch the band around the hose 22 with adequate tightness but not so tight as to damage either the band or the hose. The tool is particularly characterized by its ability to tighten like bands with substantially uniform tension and without requiring that the free end of the bands be specially formed in order for the tool to pull and tighten the bands.

More specifically, the present tool 20 includes a reversible power-operated pneumatic actuator 32 (FIGS. 1 and 2) having a cylinder 33 to which is attached a pistol-grip handle 34. The cylinder is divided into two chambers 35 and 36 (FIG. 2) which slidably receive pistons 37 and 38, respectively. A rod 39 is attached rigidly to both pistons and extends slidably through the forward end of the cylinder. When a trigger 40 on the handle 34 is squeezed, a reversing valve 41 is shifted to a position causing pressurized air from a line 42 to be admitted into the forward end portions of both chambers 35 and 36 thereby to retract the rod 39 rearwardly. Upon release of the trigger, the valve 41 shifts to a position causing air under pressure to flow into the rear end portion of the chamber 35 and thereby return the rod forwardly. Because of the dual piston construction of the actuator 32, the actuator is relatively compact and low in weight and yet the rod 39 is capable of exerting a force of significant magnitude when the rod is retracted rearwardly by pressure applied to the forward ends of the pistons 37 and 38.

Figure 5:
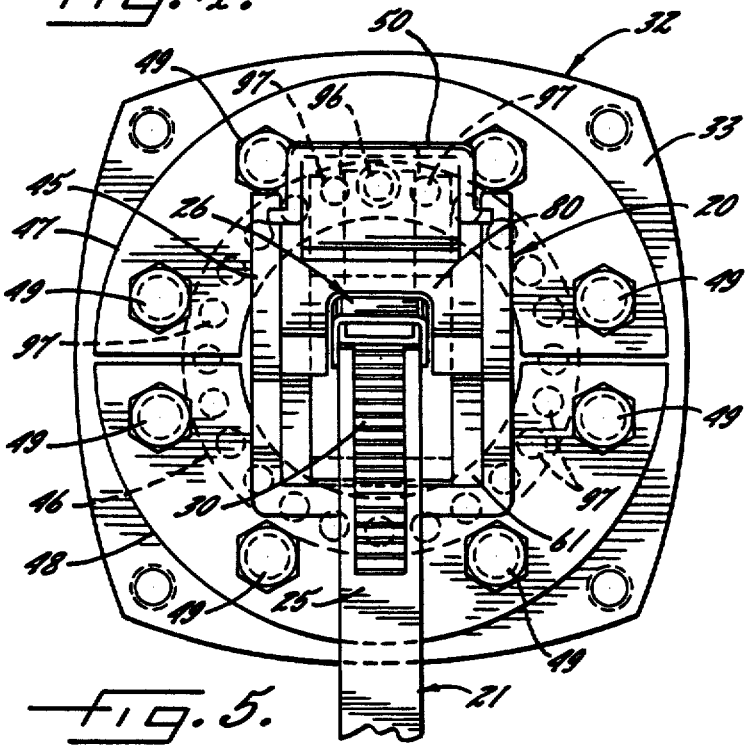
FIG. 5 is an enlarged end view of the tool as taken along the line 5—5 of FIG. 2.

The tool 20 includes a fixed main body 45 (FIG. 2) whose rear end is formed with a flange 46 which is held between the forward end of the cylinder 33 and a pair of semi-circular mounting flanges 47 and 48 (FIG. 5) which are attached to the forward end of the cylinder by screws 49. The rear end portion of the body 45 is tubular while the forward end portion of the body is generally U-shaped in cross-section as shown most clearly in FIG. 5. A removable cover 50 is secured to the U-shaped forward end portion of the body 45 by a screw 51 (FIG. 7) and serves to close the forward end portion of the body while allowing selective access to components within the body.

Tightening of the clamping band 25 is effected through the coaction of a forming punch 55 and an anvil 56. As shown most clearly in FIG. 4, the forming punch 55 is generally in the shape of a V and includes flat forward and rearward sides which converge toward one another upon progressing downwardly. The lower tip of the forming punch is convexly radiused.

Figure 6:
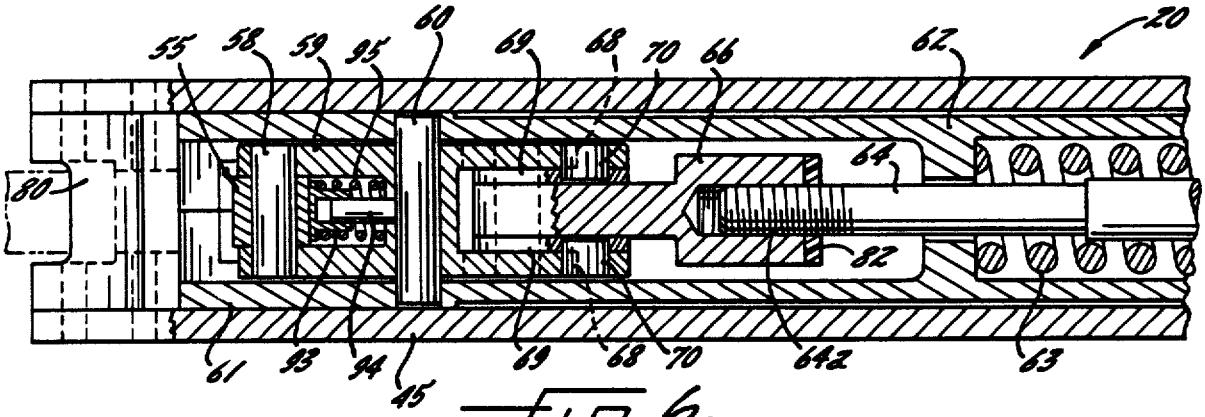
FIG. 6 is a fragmentary cross-section taken substantially along the line 6—6 of FIG. 4.

The upper end portion of the forming punch 55 is secured by a set screw 57 (FIG. 4) to a horizontal pivot pin 58 (FIG. 4) whose end portions are supported to turn by a pivot block 59. A horizontal pivot pin 60 extends through the block 59 and supports the latter to turn relative to a carriage 61 (FIGS. 4 and 6) which is located within the body 45 of the tool 20. The forward end portion of the carriage 61 corresponds generally in shape to the shape of the forward end portion of the body 45 while the rear end portion of the carriage is formed by a sleeve 62 (FIGS. 2 and 4) which is telescoped slidably into the tubular rear end portion of the body. The carriage 61 is guided slidably by the body 45 to move linearly and rearwardly relative thereto from a first or advanced position shown in FIGS. 2, 4 and 7 to a second or retracted position shown in FIG. 8.

Located within the sleeve 62 of the carriage 61 is a coiled compression spring 63 (FIGS. 2 and 4) which is telescoped over a rod 64 attached to and forming an extension of the actuator rod 39, the spring being compressed between the forward end of the sleeve 62 and a head 65 (FIG. 7) on the rear end of the extension rod 64. The forward end portion of the extension rod 64 extends through the forward end of the sleeve 62 and is threaded as indicated at 64*a* (FIG. 7) so as to enable the extension rod to be connected to a driver block 66 whose forward end carries a horizontal axle 67 which supports a pair of rollers 68 adapted to ride along the bottom of the carriage 61. Two links 69 are supported pivotally on the axle 67 and are connected pivotally at their upper ends to the rear of the pivot block 59 by horizontal pivot pins 70.

The anvil 56 underlies the forming punch 55 and is formed by two side-by-side anvil blocks 56*a* and 56*b* (FIG. 11) which are secured rigidly to the forward end portion of the carriage 61 by screws 71 and a knock-out pin 72. The anvil is formed with an upwardly opening and downwardly tapered throat 75 (FIG. 10) which generally has the same V-shaped configuration as the punch 55. Cylindrical anvil pins 76 and 77 made of very hard material such as tungsten carbide are located at the upper end of the throat adjacent the forward and rear sides thereof and define radiused forming surfaces at the upper end of the throat.

Figure 4:
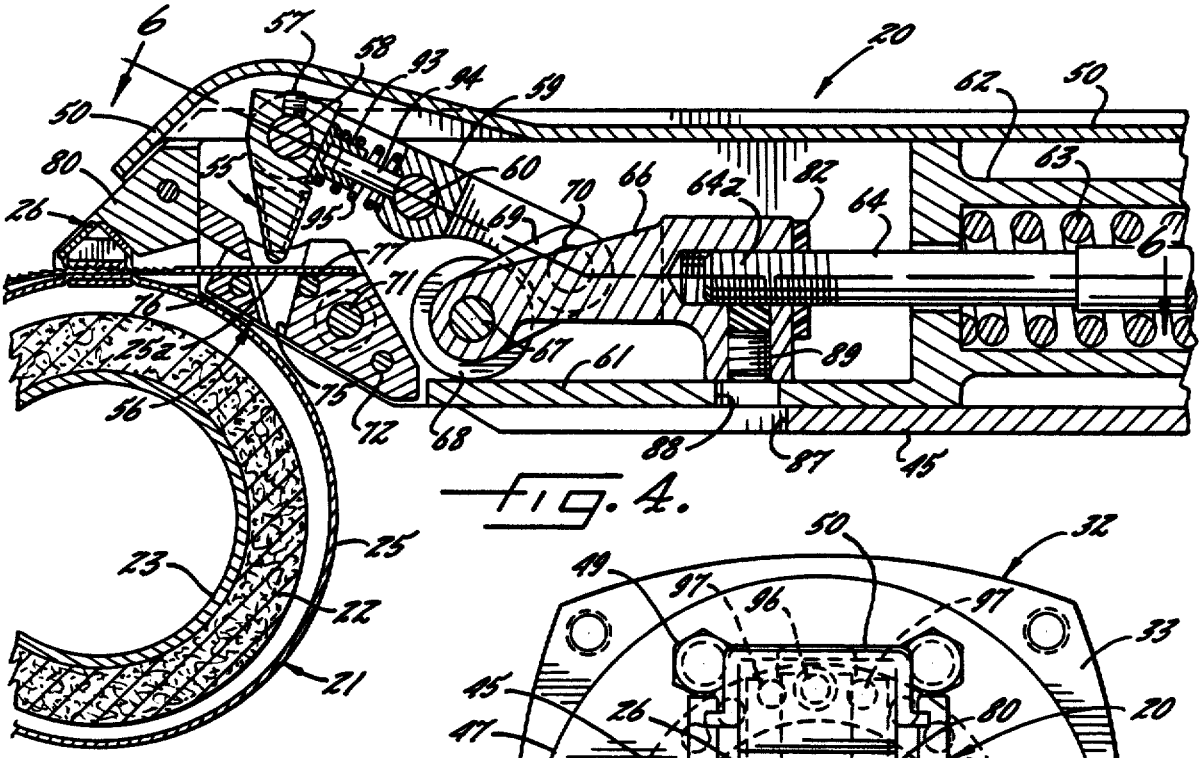
FIG. 4 is an enlarged fragmentary view of certain parts shown in FIG. 2.

To gain an understanding of the operation of the tool 20 as described thus far, assume that a clamp 21 has been loosely preassembled with a hose 22 which is to be secured to a pipe 23 and assume that the free end portion 25*a* of the clamping band 25 has been prethreaded through the locking clip 26 of the clamp and is extending from the clip as shown in FIGS. 2 and 4. Also assume that the trigger 40 of the valve 41 is released and that the pistons 37 and 38 are advanced fully in the cylinder 33 as shown in FIG. 2. When the pistons are in this position, the carriage 61 is held in its forwardmost advanced position while the forming punch 55 is raised to an inactive position in upwardly spaced relation with the anvil 56 (see FIGS. 2 and 4).

A clamp tightening cycle is initiated by the operator positioning the tool 20 such that a nosepiece 80 (FIGS. 2 and 4) which is rigid with the body 45 is located in abutting relation with the locking clip 26 of the clamp 21. When the tool is brought into this position, the free end portion 25*a* of the clamping band 25 threads between the forming punch 55 and the anvil 56 and threads across the throat 75 of the anvil so as to be supported on the anvil pins 76 and 77 as shown in FIG. 4.

Figures 7, 8, 9:
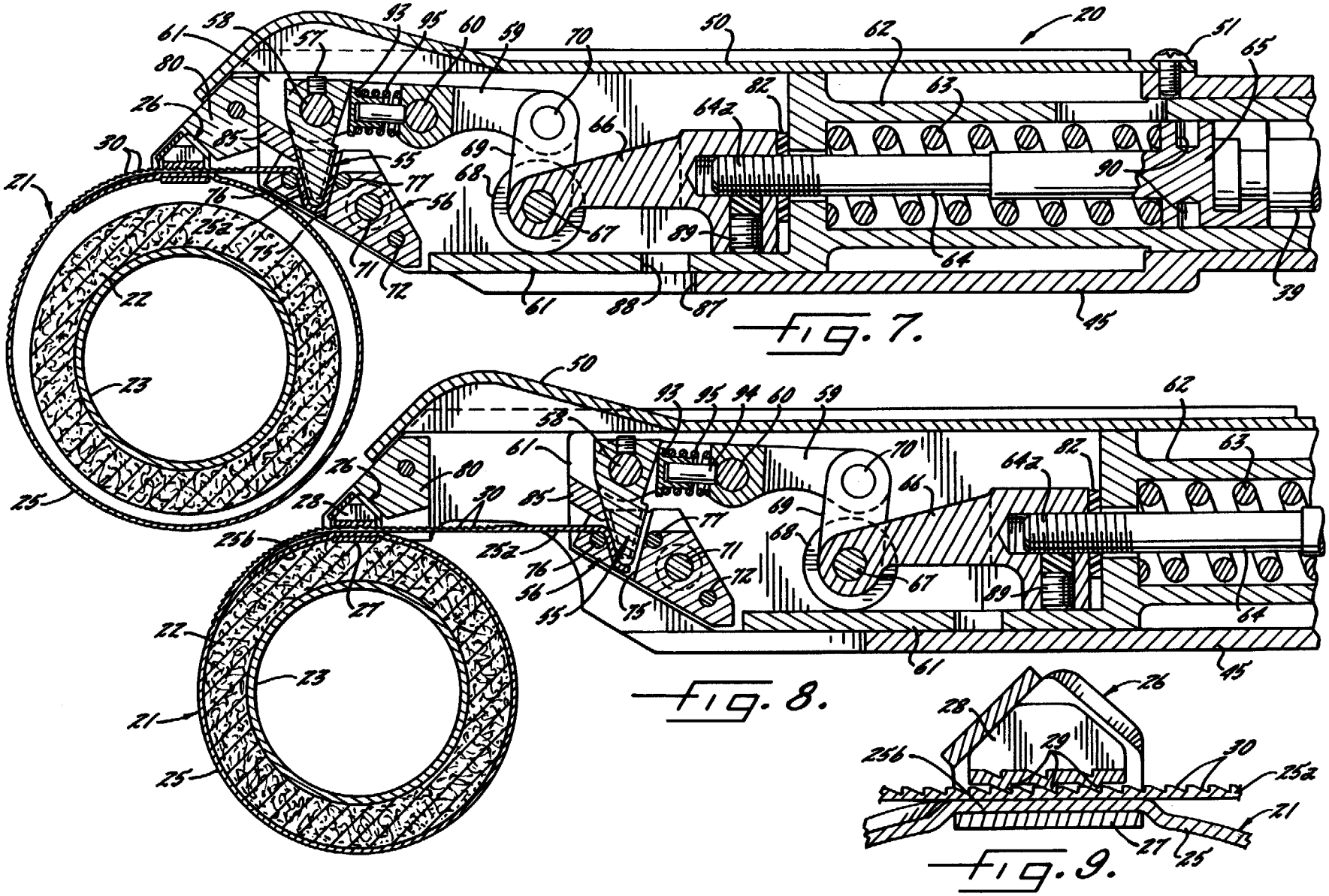
FIGS. 7 and 8 are cross-sectional views similar to FIG. 4 but show certain parts of the tool in successively moved positions during tightening of the clamp.
FIG. 9 is a cross-sectional view of certain portions of the clamp.
Figure 10:
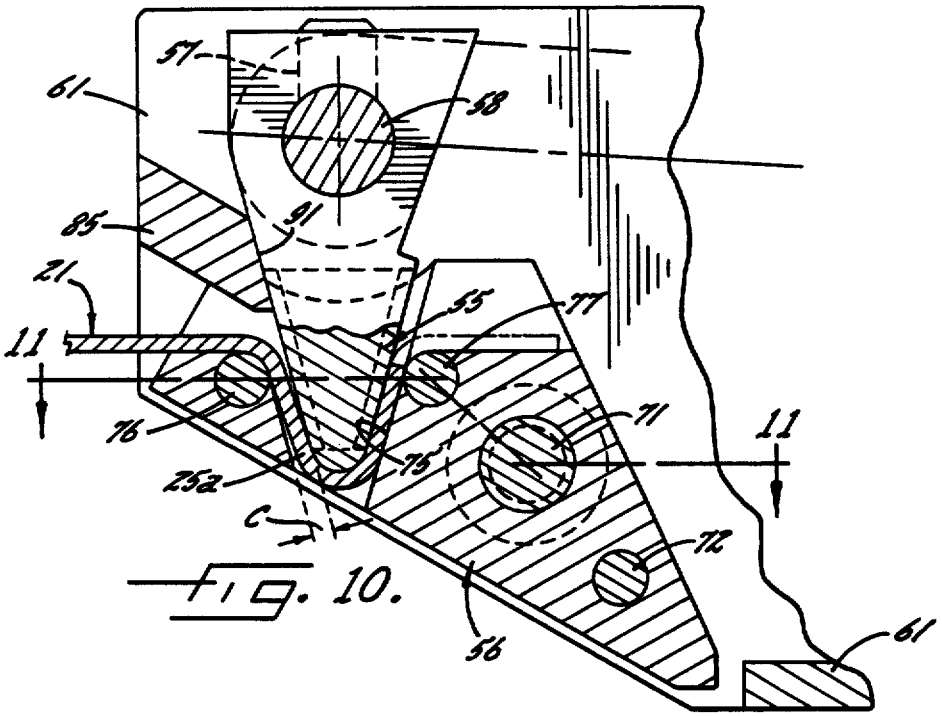
FIG. 10 is an enlarged view of the forming punch and anvil shown in FIG. 7.
Figure 11:
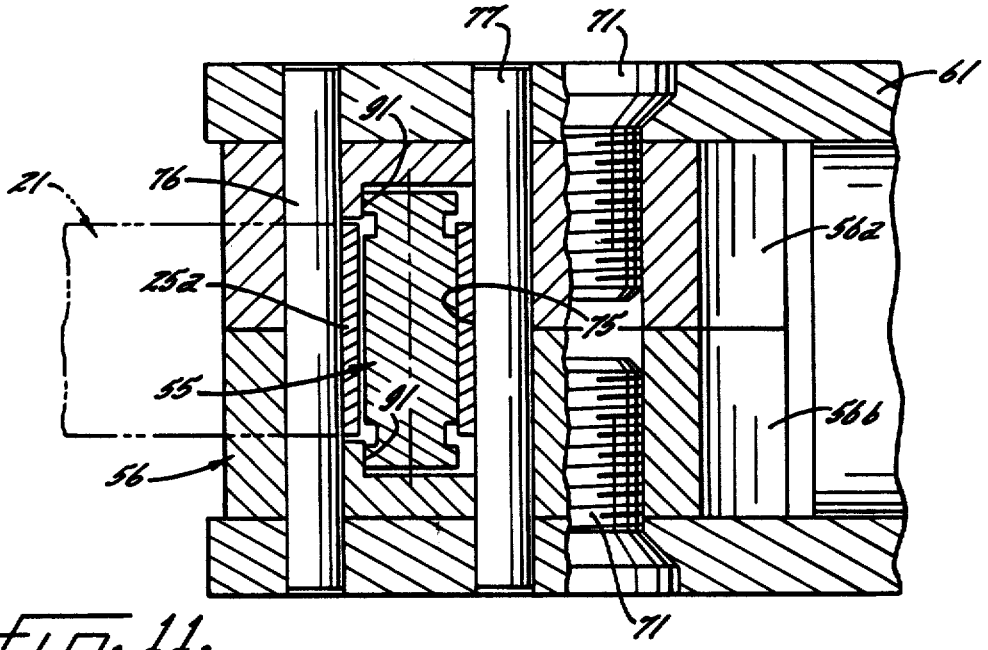
FIG. 11 is a fragmentary cross-section taken substantially along the line 11—11 of FIG. 10.

The operator then squeezes the trigger 40 to shift the valve 41 to a position causing the pistons 37 and 38 and the rods 39 and 64 to retract rearwardly from the position shown in FIG. 2. As an incident thereto, the rod 64 pulls the driver block 66 rearwardly relative to the carriage 61 so as to cause the links 69 to pivot counterclockwise about the axle 67. During such pivoting, the links 69 act on the pivot block 59 to force the latter to swing counterclockwise about the pin 60 and thereby lower the forming punch 55 toward the anvil 56 and to an active position (FIGS. 7, 8 and 10).

As the forming punch 55 swings downwardly, it engages the free end portion 25*a* of the clamping band 25 and rams the band downwardly into the throat 75 of the anvil 56. During such ramming, the abutting engagement between the nosepiece 80 of the tool 20 and the locking clip 26 of the clamp 21 maintains a fixed spacing between the clip and the front anvil pin 76. Accordingly, the punch 55 moving downwardly into the throat 75 causes the band 25 to slip forwardly across the rear anvil pin 77 and to bend and draw downwardly around the front anvil pin 76. This bends the free end portion 25*a* of the band around the punch 55 and generally into the shape of a V (see FIGS. 7 and 10).

Downward pivoting of the forming punch 55 to its active position stops when an abutment or spacer washer 82 (FIGS. 4 and 7) on the rear end of the driver block 66 engages the forward end of the sleeve 62 of the carriage 61. As a result of such engagement, further rearward retraction of the rods 39 and 64 causes the carriage 61 to slide rearwardly relative to the body 45 and effects rearward shifting of all of the components supported by the carriage.

Since the locking clip 26 of the clamp 21 is prevented from shifting rearwardly by the nosepiece 80, rearward shifting of the forming punch 55 and the anvil 56 pulls the clamping band 25 into cinching relationship with the hose 22. Once the band has clamped downwardly around the hose, the band is prevented from being pulled rearwardly through any significant distance but instead attempts to pull around the forming punch 55 and out of the throat 75. In order to do this, the band must reform itself from its V-shaped configuration as the band draws around the lower nose of the punch and across the front anvil pin 76. This drawing action applies a significant tensioning force to the band and, when the force reaches a magnitude of about 500 pounds, the band automatically "breaks away" from between the punch and the front anvil pin and slips out of the throat 75. A relatively short and somewhat S-shaped tab 84 (FIG. 3) is left at the extreme free end of the band and, if the required magnitude of tensioning force was applied to the band, the metal outer surface of the tab will have a somewhat dull or frosted appearance as indicated by the stippling 84 in FIG. 3. The frosted appearance results from the tab being reshaped around the front anvil pin 76 while under significant force and, absent such appearance, an inspector can determine that the clamping band may not have been adequately tensioned.

When the band 25 "breaks away" and slips out of the throat 75, the operator releases the trigger 40 to shift the reversing valve 41 and cause pressurized air to advance the pistons 37 and 38 and the rods 39 and 64 forwardly. During the initial forward advance, the spring 63 acts as a rigid link between the head 65 of the rod 64 and the forward end of the carriage sleeve 62. As a result, the carriage 61 and all of the components supported by the carriage move forwardly in unison until a stop block 85 (FIGS. 7 and 8) located near the anvil 56 engages the nosepiece 80 and prevents further movement of the carriage beyond the advanced position shown in FIG. 7. With continued forward movement of the rod 64, the spring 63 yields to allow the rod and the driver block 66 to keep moving forwardly. Forward movement of the driver block is transmitted to the forming punch 55 by way of the links 69 which cause the pivot block 59 to swing clockwise about the pivot pin 60 and thereby swing the punch upwardly to its inactive position (FIG. 4) in spaced relation with the anvil 56 preparatory to the start of the next cycle. Forward movement of the rod 64 relative to the carriage 61 compresses the spring 63 and stores energy which is used during the next cycle to assist the pneumatic actuator 32 in retracting the rod 64 rearwardly. This helps reduce the size and weight of the actuator.

As pointed out above, the band 25 is tensioned by virtue of the band being reformed around the lower tip of the punch 55 and the front anvil pin 76. Friction at the angular surfaces of the punch and the arcuate surface of the anvil pins 76 and 77 is not desirable since the tension from band-to-band could vary greatly due to tolerance variations in the thickness of the bands. Thus, the location of the spacer 82 along the rod 64 prevents the punch from lowering so far as to grip the band between the inclined sides of the punch 55 and the throat 75. The position of the spacer 82 along the rod 64 may be adjusted by inserting a tool through a slot 87 (FIG. 4) in the lower side of the body 45 and a hole 88 in the lower side of the carriage 61 to loosen a set screw 89 which normally locks the rod 64 to the driver block 66. With the cover 50 removed, a tool may be inserted into one or more of a pluralty of angularly spaced holes 90 (FIGS. 2 and 7) in the head 65 of the rod 64 and used to turn the rod. When the rod 64 is turned, and depending on the direction of turning, its threaded end portion 64*a* causes the driver block 66 to move forwardly or rearwardly to change the initial spacing between the spacer 82 and the forward end of the carriage sleeve 62 and thereby determine the depth to which the punch 55 descends into the throat 75 of the anvil 56 when the punch is pivoted counterclockwise toward its active position.

It also is important to maintain a running clearance between the band 25 and the forward sides of the punch 55 and the throat 75 so as to prevent the band from locking up between the wedge and the throat during tensioning and being unable to slide free during "break away". For this purpose, the anvil blocks 56*a* and 56*b* are formed with ledges 91 (FIG. 11) which engage portions of the front side of the punch to hold the punch away from the front side of the throat 75 and the front anvil pin 76. This maintains a predetermined running clearance (designated by the letter "c" in FIG. 10) along opposite sides of the free end portion 25*a* of the band to prevent the latter from being locked between the forward sides of the punch 55 and the throat 75.

When the forming punch 55 is pivoted from its inactive position to its active position, it tends to swing in an arc about the axis of the pivot pin 60. Because the punch is connected rigidly to the pin 58 and because the pin 58 is turnable in the pivot block 59, the punch is free to swing about the axis of the pin 58 and seek out the throat 75 of the anvil 56 when the block is pivoted to its active position about the pin 60. To maintain control over the punch, a plunger 93 (FIG. 4) engages the upper rear side of the punch and is slidably mounted on a rod 94 which is secured to the pivot block 59. A coil spring 95 is telescoped over the rod 94 and is compressed between the pivot block 59 and the plunger 93 so as to urge the latter against the punch 55.

The axis of the rod 94 intersects the axes of the pins 58 and 60. Accordingly, when the forming punch 55 is in its inactive position shown in FIG. 4, the plunger merely applies a steady biasing force on the punch and yieldably holds the punch against turning in either direction about the axis of the pin 58. When the punch is swung downwardly and engages the clamping band 25, the spring 95 yields to enable the punch to turn about the axis of the pin 58 to the degree necessary to enter the throat 75 (see FIG. 7). Thus, the plunger 93 and the spring 95 provide a self-centering action to allow the lower end portion of the punch to deviate from swinging in an arc around the axis of the pin 60 and permitting the punch to aline itself with the throat 75.

Advantageously, detent means are provided for holding the body 45 of the tool 20 in different selected angular positions relative to the actuator 32 so that the operator can keep the pistol-grip handle 34 in a convenient position while locating the punch 55 and the anvil 56 in the proper angular position to receive the free end portion 25*a* of the clamping band 25. Herein, the detent means comprise a spring-loaded plunger 96 (FIG. 2) supported by the mounting flange 47 of the cylinder 33 and adapted to enter one of a series of holes 97 (FIG. 5) formed in the flange 46 at the rear end of the tool body 45 and spaced 15 degrees from one another. The flange 46 is rotatably supported by the flanges 47 and 48 and is normally held in a fixed angular position by the plunger 96. By pulling on a knob 98 (FIG. 2) at the forward end of the plunger 96, the latter may be released from the selected hole 97 to enable the body 45 to be rotated about the axis of the cylinder 33 and thereby change the angular position of the punch 55 and anvil 56 relative to the handle 34. This enables the tool to be positioned to gain access to variously located clamps.

I claim:

1. A tool for tightening a clamp having an annular clamping band and having locking means for holding the band in a tightened condition, said band having a free end portion extending from said locking means, said tool comprising a body, a carriage supported by said body to move back and forth relative thereto between first and second positions, an anvil supported to move with said carriage, said anvil defining a throat for receiving at least part of the free end portion of said band, a forming punch supported to move with said carriage, said punch also being supported to move relative to said carriage between inactive and active positions, said punch being spaced from said anvil when in said inactive position thereby to permit the free end portion of said band to be threaded between said punch and said anvil, said punch being operable when moved to said active position to ram at least part of the free end portion of said band into the throat in said anvil and thereby bend the band around the punch, and actuator means which are operable when actuated to (A) first move said punch from said inactive position to said active position so as to cause said punch to bend said band and (B) thereafter move said carriage from said first position to said second position to cause said punch and anvil to tension and tighten said band.

2. A tool as defined in claim 1 in which said carriage is supported to slide back and forth on said body between said first and second positions, said punch being mounted on said carriage to pivot between said inactive and active positions.

3. A tool as defined in claim 2 in which said actuator means comprises a power-operated reciprocable rod, and a drive linkage between said rod and said punch and operable to pivot said punch back and forth between said inactive and active positions as said rod is reciprocated back and forth.

4. A tool as defined in claim 3 further including abutment means on said rod and engageable with said carriage after said rod has been shifted through a predetermined distance in a direction to pivot said punch to said active position, engagement of said abutment means with said carriage being effective to shift said carriage from said first position to said second position upon continued shifting of said rod in said direction.

5. A tool as defined in claim 1 in which said punch and said throat are generally complementary in shape, said punch being generally V-shaped.

6. A tool as defined in claim 5 in which each of said punch and said throat includes inclined front and rear sides, and means for establishing a predetermined spacing between the front sides of said punch and said throat when said punch is in said active position.

7. A tool as defined in claim 5 in which said throat includes an open end and inclined front and rear sides, said anvil being radiused at the front side of said throat adjacent the open end thereof.

8. A tool as defined in claim 1 in which said body includes means for engaging the locking means of said clamp to hold said body and said locking means against any substantial relative movement as said carriage is moved from said first position to said second position.

9. A tool for tightening a clamp having an annular clamping band and having locking means for holding the band in a tightened condition, said band having a free end portion extending from said locking means, said tool comprising a body, a carriage guided by said body to slide linearly back and forth between first and second positions, an anvil supported to move with said carriage, said anvil defining a generally V-shaped throat for receiving at least part of the free end portion of said band, a generally V-shaped forming punch supported to move linearly with said carriage, said punch also being supported to pivot on said carriage between inactive and active positions, said punch being spaced from said anvil when in said inactive position thereby to permit the free end portion of said band to be threaded between said punch and said anvil and across said throat, said punch being operable when pivoted to said active position to ram at least part of the free end portion of said band into said throat and thereby form a generally V-shaped bend in said band while causing the band to be located in said throat between said punch and said anvil, and a pneumatic actuator attached to said body and having a reciprocable rod operably connected to said punch and said carriage, said rod being operable when shifted in one direction to (A) first pivot said punch from said inactive position to said active position so as to cause said punch to bend said band and (B) thereafter move said carriage from said first position to said second position to cause said punch and anvil to tension and tighten said band.

10. A tool as defined in claim 9 in which said punch includes a convexly radiused tip, said throat having an open end and a forward side, and said anvil including a cylindrical pin located at the forward side of said throat near the open end thereof and engageable with said band.

11. A tool as defined in claim 10 further including a second cylindrical pin extending parallel to said one pin and located on the opposite side of said throat near the upper end thereof, said second pin being engageable with said band before the band is rammed into said throat.

12. A tool as defined in claim 9 further including means for releasably holding said body in selected angular positions relative to said actuator.

13. A tool as defined in claim 9 in which said actuator comprises a pair of end-to-end chambers, a piston slidable within each of said chambers, said rod being connected to said pistons, and means for admitting pressurized air into both of said chambers to effect movement of said carriage from said first position to said second position.

14. A tool as defined in claim 13 further including a spring located between said rod and said carriage and positioned to be compressed when said rod moves said punch from said active position to said inactive position.

* * * * *